US006112741A

United States Patent [19]

Stickford et al.

[11] Patent Number: 6,112,741

[45] **Date of Patent: *Sep. 5, 2000**

[54] MID-EFFICIENCY FURNACE WITH MULTIPLE VENTING OPTION

[75] Inventors: George H. Stickford, Dublin; Terry Merriman; Sherwood Talbert, both of Columbus; Allen Rutz, Hilliard; James H. Saunders, Worthington; David A. Ball, Westerville; Jan Yates, Reynoldsburg, all of Ohio

[73] Assignee: Gas Research Institute, Chicago, Ill.

[ * ] Notice: This patent is subject to a terminal disclaimer.

[21] Appl. No.: 09/303,804

[22] Filed: Apr. 30, 1999

Related U.S. Application Data

[63] Continuation-in-part of application No. 08/847,619, Apr. 28, 1997.

[51] Int. Cl.[7] ..... F24C 1/14

[52] U.S. Cl. ..... 126/80; 126/110 R; 126/290; 126/312

[58] Field of Search ..... 126/80, 85 B, 126/110 R, 116 R, 307 R, 312, 290; 110/160, 162, 163, 147

[56] References Cited

U.S. PATENT DOCUMENTS

| | | | |
|---|---|---|---|
| 4,163,441 | 8/1979 | Chen | 126/116 A |
| 4,289,730 | 9/1981 | Tomlisnon | 422/178 |
| 4,424,792 | 1/1984 | Shimek et al. | 126/80 |
| 4,515,145 | 5/1985 | Tallman et al. | 126/99 A |
| 4,688,547 | 8/1987 | Ballard et al. | 126/116 A |
| 4,951,651 | 8/1990 | Shellenberger et al. | 126/110 R |
| 4,974,579 | 12/1990 | Chellenberger et al. | 126/110 R |
| 5,012,793 | 5/1991 | Guzorek | 126/85 R |
| 5,038,751 | 8/1991 | Riedling | 126/116 A |
| 5,056,500 | 10/1991 | Evens | 126/110 R |
| 5,113,844 | 5/1992 | Cook | 126/110 R |
| 5,174,271 | 12/1992 | Seo | 126/110 R |
| 5,255,665 | 10/1993 | Windon | 126/312 |
| 5,379,749 | 1/1995 | Rieke et al. | 126/110 R |
| 5,941,230 | 8/1999 | Rutz | 126/80 |

OTHER PUBLICATIONS

New Vent Sizing Tables, A.G.A. Laboratories, 1990, pp. 1–3, 12–17.

Accessory Masonory Chimney Venting Kit Specifications, Inter–City Products Corporation, Aug. 1995, 1 page.

*Primary Examiner*—James C. Yeung

*Attorney, Agent, or Firm*—Pauley Petersen Kinne & Fejer

[57] ABSTRACT

A multi-category gaseous fuel-fired heating apparatus having a combustion chamber, a mixing chamber in fluid communication with the combustion chamber, and an induced draft blower in fluid communication with the mixing chamber whereby combustion air is drawn into the combustion chamber for combustion of the gaseous fuel and the flue gases are drawn from the combustion chamber through the mixing chamber and exhausted into either a high temperature flue gas vent or a low temperature flue gas vent. The mixing chamber includes a dilution air inlet which, in a high temperature vent mode of operation of the heating apparatus is sealed off by an orifice plate disposed between the mixing chamber and the induced draft blower, and in a low temperature vent mode, the dilution air inlet is open and a larger blower inlet orifice is used.

8 Claims, 5 Drawing Sheets

MID-EFFICIENCY FURNACE WITH MULTIPLE VENTING OPTION

CROSS REFERENCE TO RELATED APPLICATION

This application is a continuation-in-part application of our co-pending application having Ser. No. 08/847,619, filed Apr. 28, 1997.

BACKGROUND OF THE INVENTION

1. Field of the Invention

This invention relates to a gaseous fuel-fired heating appliance and venting systems for such appliances. More particularly, this invention relates to gaseous fuel-fired heating appliances, such as residential furnaces, having multiple venting options which are selectable at the time of installation of the appliance by the installer. In particular, the invention enables the installer to allow dilution air to enter and mix with combustion products from the heating appliance so as to adapt the appliance vent gas composition to venting systems constructed from a variety of materials.

2. Description of Prior Art

Conventional gas heating appliances, such as furnaces, boilers, and water heaters provide the user with safe, economical space and water heating, all the while requiring little maintenance over a relatively long appliance lifetime. These appliances typically use single wall galvanized vent connectors and either a masonry chimney or Type-B vent pipe to vent the flue gases generated by the combustion process during operation of the appliances. The American National Standards Institute (ANSI) categorizes gas appliances based on the pressure produced in a special test vent and the difference between the actual temperature and the dew point temperature of the flue gas.

A conventional Category I space heating appliance is one which has a vertical vent which operates under negative static vent pressure with a minimum of condensation. A Category I gas appliance has an annual fuel utilization efficiency range of about 78% to 83%. Moisture normally does not condense from the flue gas in Category I appliances because the actual flue gas temperature is generally higher than 140° F. above its dew point temperature. Conventional draft hood equipped appliances are Category I appliances as well as most mid-efficiency, fan-assisted appliances. Mid-efficiency, fan assisted appliances differ from the conventional drafthood appliance by having an induced-draft blower to draw the combustion gases through the heat exchanger and deposit them into a vent. These appliances are classified as Category I appliances if the flue gas temperature is in the same range as the conventional Category I appliance, and if the induced-draft blower and vent system are designed to maintain a negative pressure in the vent. Venting systems for Category I appliances typically include Type-B vents, lined masonry chimneys, and single wall metal vents.

Category II appliances also operate with negative vent pressure. However, because the vent gas temperature is generally less than 140° F. above its dew point temperature, corrosion of the vent is a problem requiring the designer to use corrosion resistant vents to exhaust the flue gases. As a result, there are few, if any, Category II gas appliances on the market.

Category III appliances operate with a positive vent pressure used with a vent gas temperature generally at least 140° F. above its dew point temperature. The annual fuel utilization efficiency of these appliances is typically in the range of about 78% to 83%. Because the pressure in the vent is greater than the pressure of the surrounding atmosphere, these appliances require an airtight vent to prevent leakage of flue gases into the residence. An example of a Category III appliance is a mid-efficiency furnace that is vented horizontally through the side-wall of a residence. Venting systems for Category III appliances typically include high temperature plastic and single wall stainless steel metal vents.

Category IV gas heating appliances operate with a positive vent pressure and at a vent gas temperature less than 140° F. above the dew point temperature. Category IV appliances are high efficiency, condensing units with an annual fuel utilization efficiency above 83%. Because the pressure in the vent exceeds that of the surrounding atmosphere and because condensation occurs in the vent, these appliances require an air tight, corrosion-resistant vent that is equipped for condensate disposal. Venting systems for Category IV appliances typically include polyvinylchloride ("PVC") or chlorinated polyvinylchloride ("CPVC") vents.

Accordingly, it can be seen that the category to which a particular appliance is assigned is important because it establishes the installation requirements of the venting system for the particular appliance. For example, as suggested hereinabove, a Category I appliance may utilize traditional venting materials such as Type-B vent pipe or a masonry chimney, while a Category IV appliance will require a vent system built from corrosion resistant materials.

The flue gases of gas heating appliances, such as furnaces and water heaters, contain a large amount of water vapor. Because the industry has moved to higher efficiency appliances, and, subsequently, to lower flue gas temperatures, condensation of water and corrosive substances from the flue gases onto vent system surfaces is a major design issue. Due to the consequences of condensate formation, the use of single wall metal vent connectors is severely limited by building codes and most masonry chimneys require relining before the new appliance may be installed. Converting to a Type-B connector from a single wall connector may cost the building owner up to $60, while relining a chimney to protect against condensation can cost from around $200 to $300. Furthermore, problems with Category III appliances using high temperature plastic vents have prompted some jurisdictions and some appliance manufacturers to prohibit the use of high temperature plastics. Alternative stainless steel vent systems are available at a cost in the range of about $100 to $300. Thus, it will be apparent that, in many cases, existing vents may be completely inadequate for new appliances and may discourage the building owner from installing gas appliances or require the building owner to undergo an expensive and time-consuming vent system replacement.

In an attempt to avoid these costs, several manufacturers have designed appliances with draft hoods that entrain dilution air into the vent. Entraining dilution air into the vent reduces the amount of condensation formed during operation, thereby reducing the number of installations which would require chimney relining. Unfortunately, this process also allows heated room air to escape in an uncontrolled fashion, both while the appliance is operating and while the appliance is idle. The escaping heat increases the heat load on the building, thereby increasing the energy costs associated with controlling the building temperature. Furthermore, typical draft hood equipped appliances are susceptible to backdrafting, a particularly troublesome problem in multi-story houses.

Currently, heating appliances such as residential furnaces and boilers are provided to a building owner based upon the type of vent system present in the building. As a result, manufacturers of these heating appliances are required to produce a multiplicity of different appliance models, which models must be cataloged and stored by the distributor and installer, in order to accommodate each of the possible vent systems.

SUMMARY OF THE INVENTION

Accordingly, it is one object of this invention to provide a method and device by which commercially available mid-efficiency gas appliances can be converted into appliances with multi-category venting options thereby reducing the number of different appliance models required to be produced by an appliance manufacturer as well as reducing the inventory of products required to be catalogued and stored by distributors and installers.

It is another object of this invention to provide a method and device for increasing the installation venting options available to a gas appliance installer.

These and other objects of this invention are addressed by a gaseous fuel-fired heating apparatus comprising at least one combustion chamber wall which defines a combustion chamber having a gaseous fuel inlet, an oxidant inlet, and a flue gas outlet. At least one mixing chamber wall defines a mixing chamber having a flue gas inlet in fluid communication with the flue gas outlet of the combustion chamber, a dilution air inlet, and a mixing chamber flue gas outlet. An induced draft blower having a blower flue gas inlet in communication with the mixing chamber flue gas outlet is removably secured to the mixing chamber wall. The induced draft blower is provided with a vent gas outlet which is connectable to either a high temperature flue gas vent (Category I vertical vent) or a low temperature flue gas vent (Category IV horizontal vent through a building side-wall). In order to enable selection in the field by an installer of a venting option for the appliance, the appliance comprises means for converting the appliance between a high temperature flue gas vent mode and a low temperature flue gas vent mode, which means is disposed between the mixing chamber and the induced draft blower. Thus, if a building, such as a residential home, has an existing Type-B vent (a vertical double wall vent pipe installed in a vertical chase or chimney), or a relined chimney, the installer can modify the multi-category appliance and vent it into the vertical vent. If, on the other hand, no vertical vent exists, or if it would be costly to repair or replace an existing vertical vent, the multi-category appliance of this invention can be vented into a horizontal vent of PVC pipe and fittings, and vented out the side-wall of the home.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Broadly speaking, the invention claimed herein is a gaseous fuel-fired appliance which is adaptable for varying the proportions of dilution air to combustion products in the vent gas exhaust, thereby enabling its use as a Category I or Category IV appliance. The appliance can be a furnace, a water heater, a boiler, or some other gaseous fuel-fired heating appliance which is externally vented and normally used within a building or other structure. Although described herein in the context of a gaseous fuel-fired furnace, the invention claimed herein is equally applicable to other gaseous fuel-fired appliances, and there is no intent to limit the scope of the claimed invention to the specific embodiments described herein.

Figure 1:
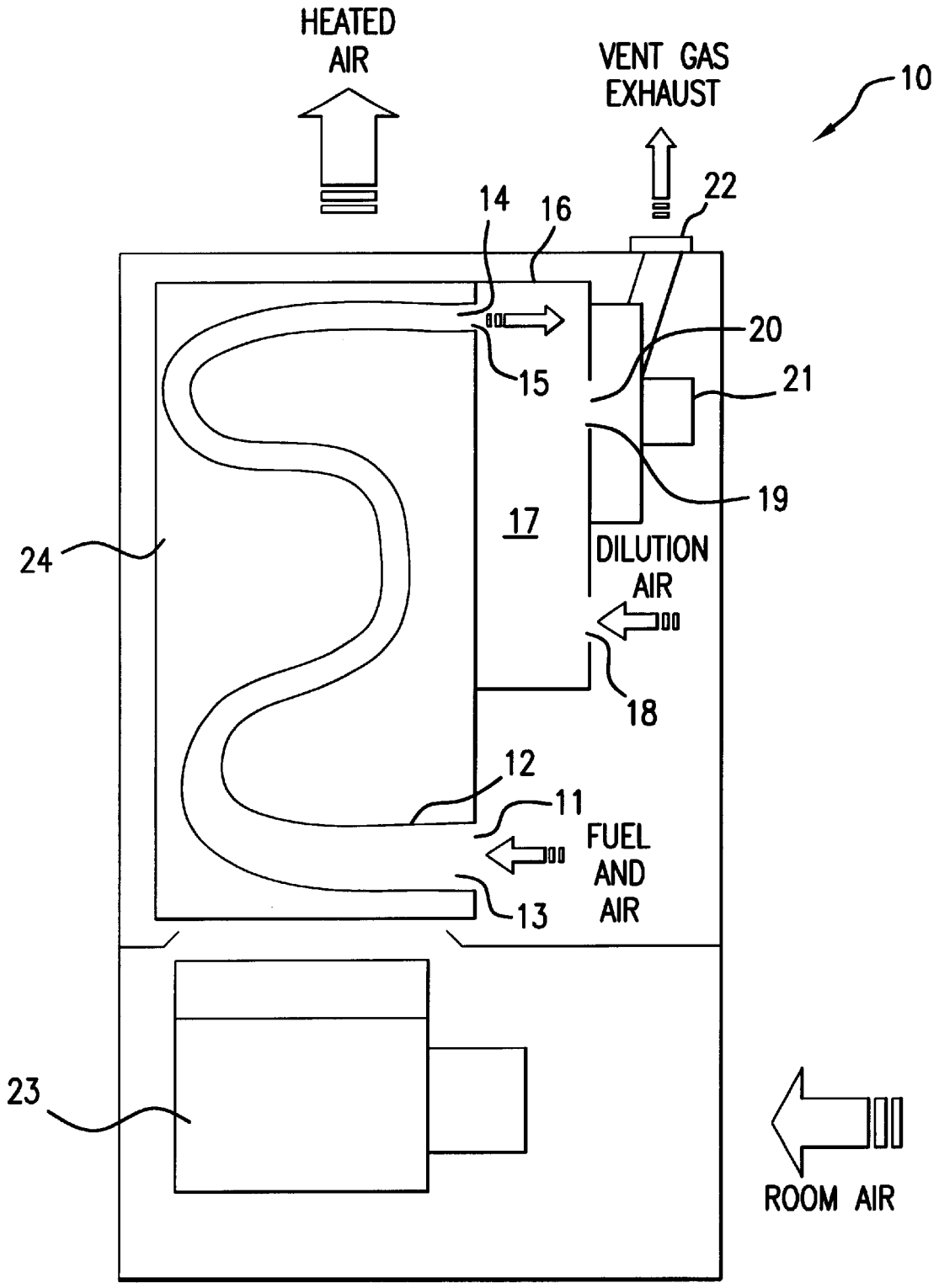
FIG. 1 is a schematic diagram of a multi-category furnace for venting into a low temperature, Category IV vent.

The invention claimed herein, in accordance with one embodiment, as shown in FIG. 1, is a furnace 10 comprising at least one combustion chamber wall 12 which forms a combustion chamber 13 for burning the gaseous fuel and air introduced through fuel and air inlet 11, and producing combustion products, that is, flue gases. The combustion chamber comprises flue gas outlet 14 for exhausting all of the flue gases from the combustion chamber. Furnace 10 further comprises at least one mixing chamber wall 16 which forms mixing chamber 17. Flue gases from combustion chamber 13 pass through flue gas outlet 14 and flue gas inlet 15 of mixing chamber 17 into mixing chamber 17. Mixing chamber 17 further comprises dilution air inlet 18 and mixing chamber flue gas outlet 19. Induced draft blower 21 having a blower flue gas inlet 20 in communication with mixing chamber flue gas outlet 19 is removably connected to mixing chamber wall 16. Induced draft blower 21 comprises vent gas outlet 22 which is connectable to either a high temperature, Category I flue gas vent or a low temperature, Category IV flue gas vent as necessary.

As shown in FIG. 1, multi-category furnace 10 is configured to vent into a low temperature flue gas vent. Combustion gases from the combustion of fuel and air in combustion chamber 13 pass through heat exchanger 24 and are cooled by circulating air blower 23 which draws return air, or room air, into furnace 10 and supplies heated air to the space being heated. The flue gases exiting combustion chamber 13 through flue gas outlet 14 enter mixing chamber 17 and mix with dilution air entering mixing chamber 17 through dilution air inlet 18. The flue gases and dilution air are both drawn into mixing chamber 17 by induced draft blower 21. The size of dilution air inlet 18 and the performance characteristics of induced draft blower 21 are adjusted to provide sufficient dilution air to cool the flue gases to safe temperatures for venting the gases into a low temperature flue gas vent such as PVC vent pipe. The amount of dilution air required to mix with and cool the flue gases (dilution air temperatures are typically 60–70° F.) ranges from about two to three times the amount of flue gases generated by the combustion of the fuel and air. Flue gas temperatures having passed through heat exchanger 24 and exiting from combustion chamber 13 are typically 300–400° F.

Figure 2:
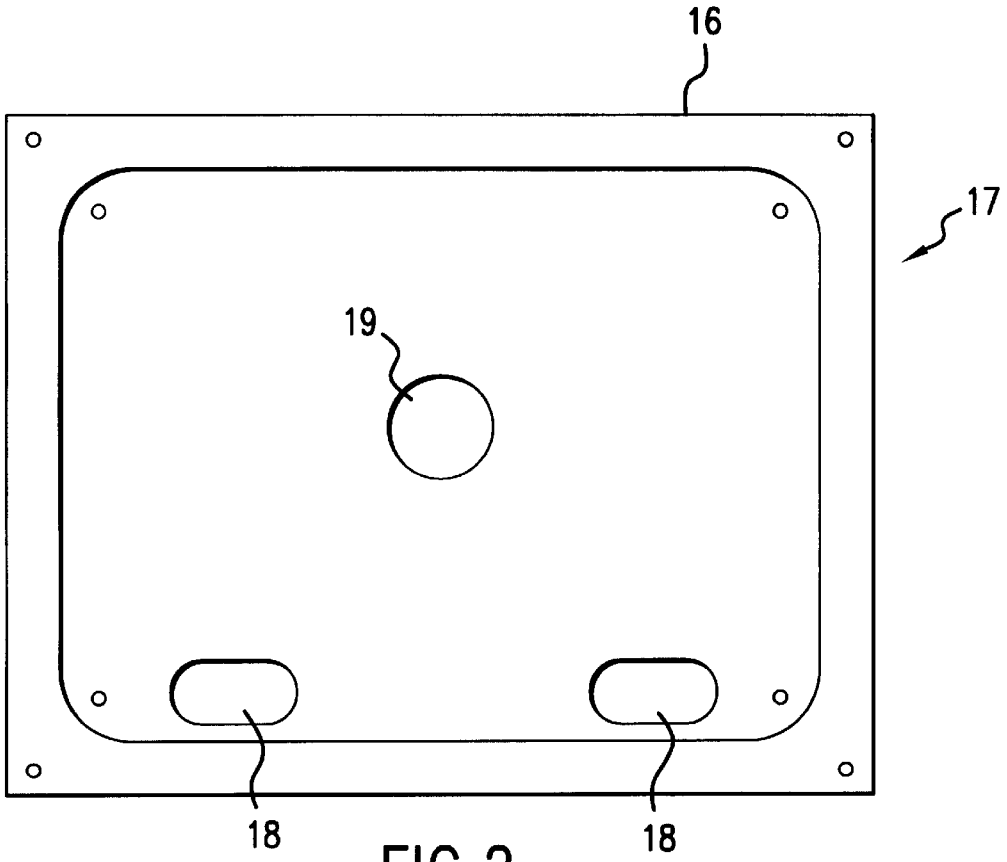
FIG. 2 is a front view of a mixing chamber wall for a multi-category furnace.

FIG. 2 is a schematic diagram of a typical mixing chamber 17 having mixing chamber flue gas outlet 19 which controls the flow of flue gases into induced draft blower 21 (FIG. 1). Mixing chamber 17 is shown as having two dilution air inlets 18 that permit dilution air to enter mixing chamber 17. For a given furnace size (gas input rate), a given heat exchanger design, a given PVC vent length, and a given induced draft blower, the size of the mixing chamber flue gas outlet 19 and dilution air openings 18 must be balanced to provide clean operation of the furnace (typically excess combustion air in the range of about 30 to 70%), as well as sufficient dilution air to cool the vent gases to safe temperatures for a PVC vent. Vent gases must be exhausted from induced draft blower 21 at a pressure sufficient to overcome the pressure drop through a PVC vent.

Figure 3:
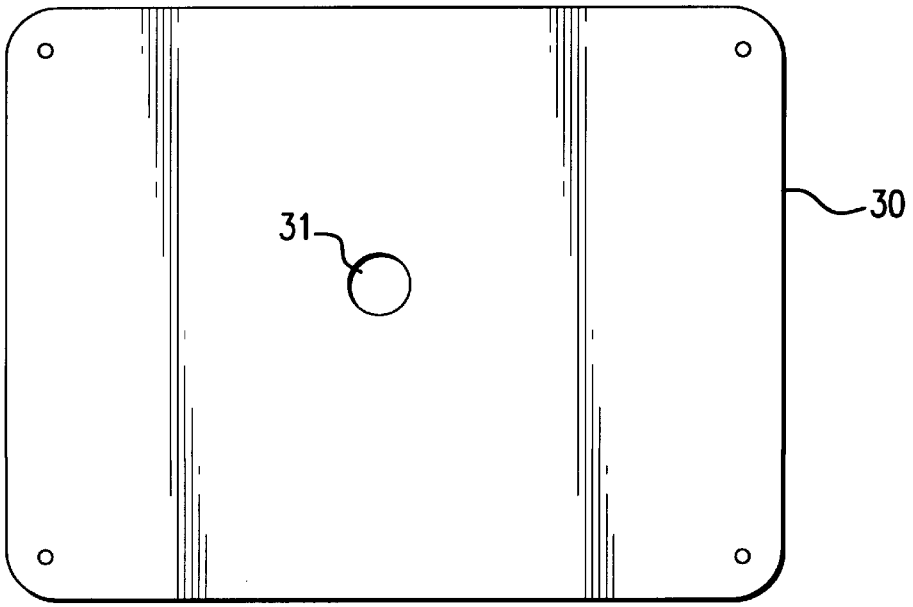
FIG. 3 is a front view of an orifice plate for converting the multi-category furnace of FIG. 1 for venting into a high temperature, Category I vent.
Figure 4:
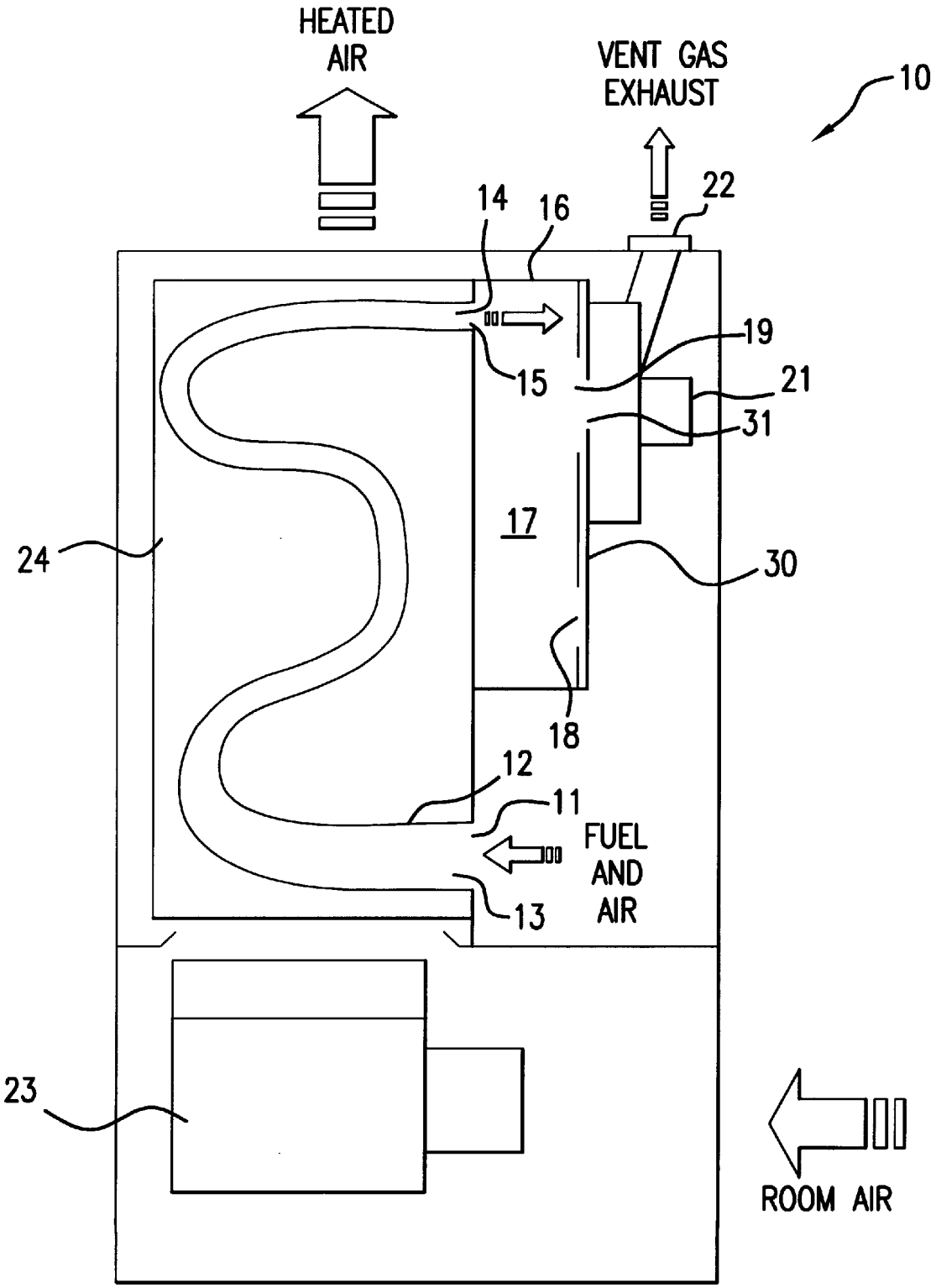
FIG. 4 is a schematic diagram of a multi-category furnace for venting into a high temperature, Category I vent.

In order to convert heating apparatus 10 between a Category IV vent mode and a Category I vent mode, in accordance with one embodiment of this invention, orifice plate 30, shown in FIG. 3, is placed between mixing chamber 17 and induced draft blower 21, as shown in FIG. 4, resulting in the sealing off of dilution air inlets 18. In addition, orifice plate 30 forms orifice 31 which is smaller than, and aligned with, mixing chamber flue gas outlet 19. As a result, multi-category heating apparatus 10, as shown in FIG. 4, is configured to vent into a Category I vent, such as a vertical Type-B vent or relined chimney. In this configuration, flue gases exiting combustion chamber 13/heat exchanger 24 through flue gas outlet 14 are drawn into mixing chamber 17 by the action of induced draft blower 21. However, in this configuration, orifice plate 30 covers dilution air inlets 18, thereby preventing dilution air from entering mixing chamber 17. Because there is no dilution air to cool the flue gases, the vent gases exit induced draft blower 21 at a temperature in the range of about 300–400° F. In this case, orifice 31 is sized to draw into the combustion chamber sufficient combustion air for clean combustion, and to exhaust the vent gases into a Category I vent at atmospheric pressure. Buoyancy forces generated by the high temperature vent gases cause the vent products to flow up the vertical Category I vent.

As shown in FIGS. 1 and 4, in order to convert multi-category heating apparatus 10 from a Category IV vent mode to a Category I vent mode, an installer merely removes induced draft blower 21, places orifice plate 30 over mixing chamber wall 16 of mixing chamber 17 and reinstalls induced draft blower 21 over orifice plate 30.

Figure 5A:
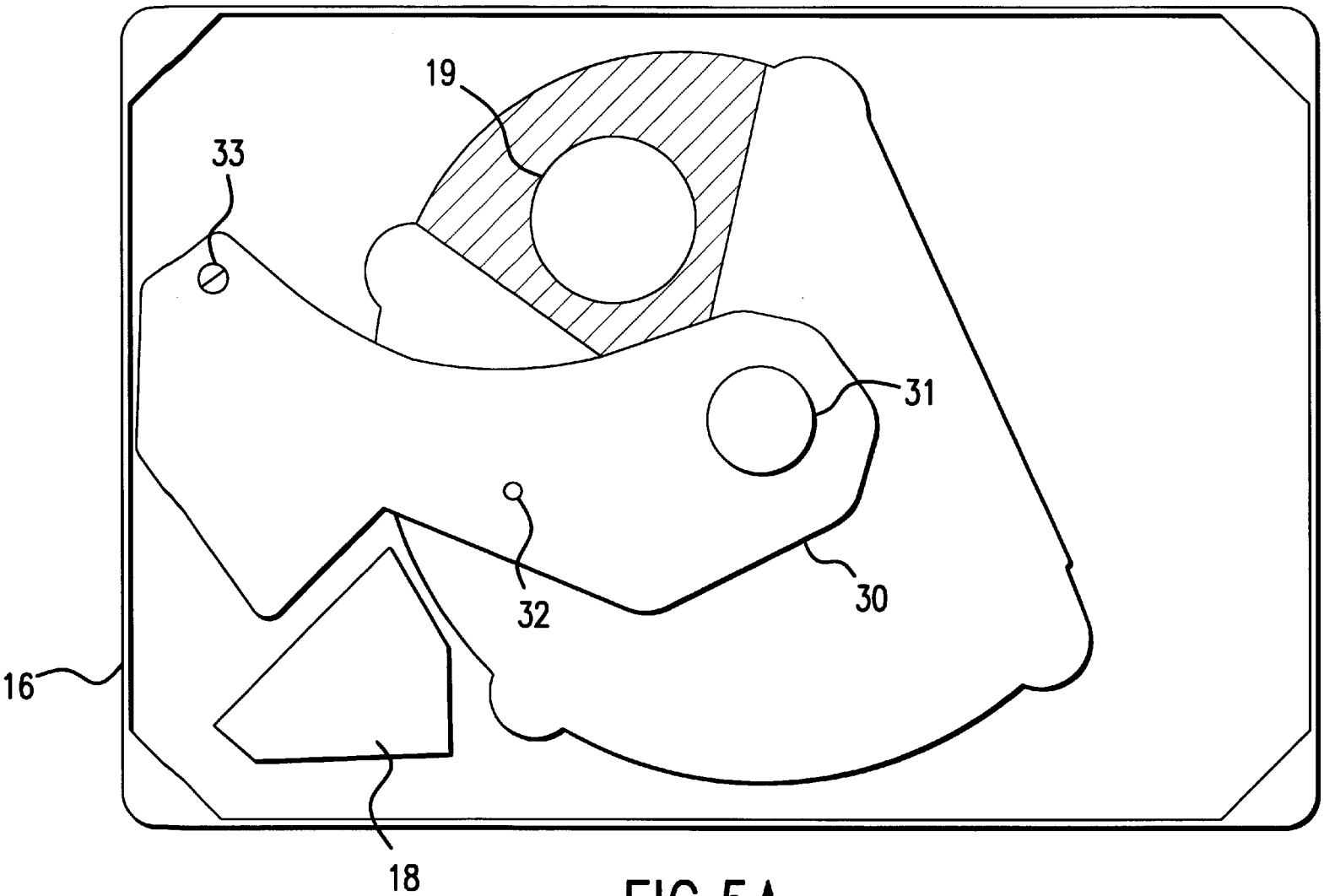
FIGS. 5A and 5B show a mixing chamber wall with a movable orifice plate attached thereto in accordance with one embodiment of this invention.
Figure 5B:
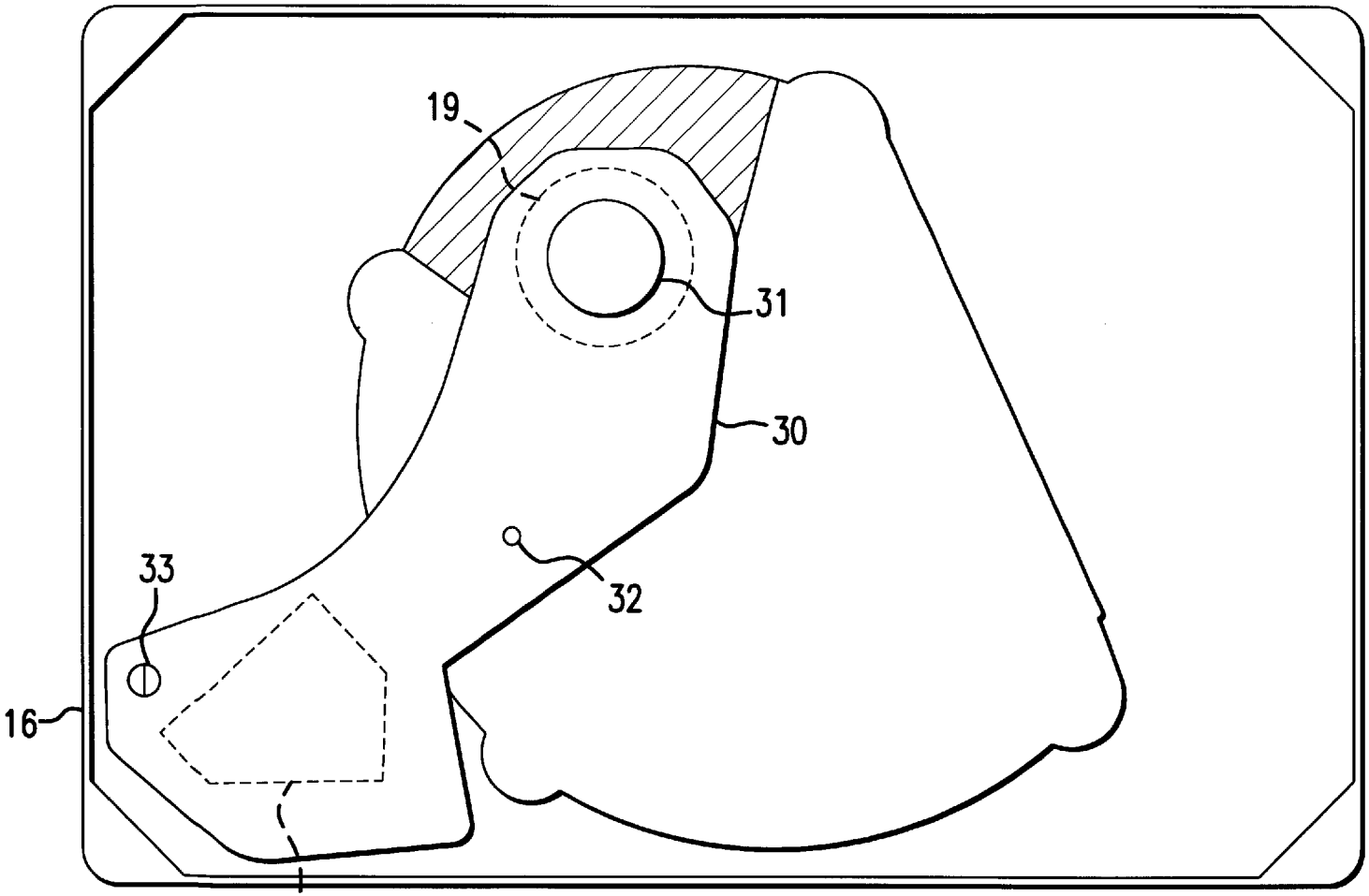

In accordance with another embodiment of this invention as shown in FIGS. 5A and 5B, orifice plate 30 is pivotally connected at pivot point 32 to mixing chamber wall 16 between mixing chamber 17 and induced draft blower 21. FIG. 5A shows a low temperature flue gas vent mode position for orifice plate 30 in which flue gases are drawn by induced draft blower 21 (not shown) through mixing chamber flue gas outlet 19 and dilution air is pulled into mixing chamber 17 through dilution air inlet 18. To prevent undesired rotation of orifice plate 30 around pivot point 32, orifice plate 30 is shown as being securable to mixing chamber wall 16 by fastener 33. In the high temperature flue gas vent mode, shown in FIG. 5B, orifice plate 30 is rotated around pivot point 32 so as to seal off dilution air inlet 18 and align orifice 31 with mixing chamber flue gas outlet 19. As shown in FIG. 5B, orifice 31 is smaller than mixing chamber flue gas outlet 19 in order to ensure sufficient draw of combustion air by induced draft blower 21 into combustion chamber 13 for clean combustion.

In a gaseous fuel-fired heating apparatus having at least one combustion chamber wall defining a combustion chamber having a gaseous fuel inlet, an oxidant inlet, and a flue gas outlet, at least one mixing chamber wall defining a mixing chamber having a flue gas inlet in fluid communication with the flue gas outlet, a dilution air inlet, and a mixing chamber flue gas outlet, and an induced draft blower removably secured to the mixing chamber wall having a blower flue gas inlet in communication with the mixing chamber flue gas outlet and a vent gas outlet, the method of this invention for converting the apparatus between a high temperature flue gas mode and a low temperature flue gas mode comprises the steps of inserting an orifice plate having an orifice with an area smaller than the mixing chamber flue gas outlet area between the mixing chamber wall and the induced draft blower so that the orifice is disposed between the mixing chamber flue gas outlet and the blower flue gas inlet and a portion of the orifice plate seals off the dilution air inlet.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A gaseous fuel-fired heating apparatus comprising:

at least one combustion chamber wall defining a combustion chamber having a gaseous fuel inlet, a combustion air inlet, and a flue gas outlet;

at least one mixing chamber wall defining a mixing chamber having a flue gas inlet in fluid communication with said flue gas outlet, a dilution air inlet, and a mixing chamber flue gas outlet;

an induced draft blower removably secured to said at least one mixing chamber wall having a blower flue gas inlet in communication with said mixing chamber flue gas outlet, and a vent gas outlet connectable to one of a high temperature vent and a low temperature vent; and means for converting said apparatus between a high temperature vent mode and a low temperature vent mode, said means disposed between said mixing chamber and said induced draft blower.

2. An apparatus in accordance with claim 1, wherein said means for converting said apparatus between said high temperature vent mode and said low temperature vent mode comprises an orifice plate securable to said at least one mixing chamber wall, said orifice plate sealing off said dilution air inlet and forming an orifice having an area smaller than said mixing chamber flue gas outlet area, said orifice aligned with said mixing chamber flue gas outlet.

3. An apparatus in accordance with claim 1, wherein said means for converting said apparatus between said high temperature vent mode and said low temperature vent mode comprises an orifice plate secured to said at least one mixing chamber wall, said orifice plate forming an orifice having an area smaller than said mixing chamber flue gas outlet area and being movable between a high temperature vent position and a low temperature vent position.

4. An apparatus in accordance with claim 3, wherein, in said high temperature vent position, said orifice plate seals off said dilution air inlet and said orifice is aligned with said mixing chamber outlet and said blower flue gas inlet, and in said low temperature flue gas vent position, said dilution air inlet is open and said orifice is not in communication with said mixing chamber flue gas outlet and said blower flue gas inlet.

5. In a gaseous fuel-fired heating apparatus having at least one combustion chamber wall defining a combustion chamber having a gaseous fuel inlet, an oxidant inlet, and a flue gas outlet, at least one mixing chamber wall defining a mixing chamber having a flue gas inlet in fluid communication with said flue gas outlet, a dilution air inlet, and a mixing chamber flue gas outlet, and an induced draft blower removably secured to said at least one mixing chamber wall having a blower flue gas inlet in communication with said mixing chamber flue gas outlet and a vent gas outlet, the improvement comprising:

means for converting said apparatus between a high temperature vent mode and a low temperature vent mode, said means disposed between said mixing chamber and said induced draft blower.

6. A gaseous fuel-fired heating apparatus in accordance with claim 5, wherein said means for converting said apparatus between said high temperature vent mode and said low temperature vent mode comprises an orifice plate secured to said at least one mixing chamber wall, said orifice plate forming an orifice having an area smaller than said mixing chamber flue gas outlet area and being movable between a high temperature vent position and a low temperature vent position.

7. A gaseous fuel-fired heating apparatus in accordance with claim 6, wherein, in said high temperature vent position, said orifice plate seals off said dilution air inlet and said orifice is aligned with said mixing chamber flue gas outlet and said blower flue gas inlet, and in said low temperature vent position, said dilution air inlet is open and said orifice is not in communication with said mixing chamber flue gas outlet and said blower flue gas.

8. In a gaseous fuel-fired heating apparatus having at least one combustion chamber wall defining a combustion chamber having a gaseous fuel inlet, an oxidant inlet, and a flue gas outlet, at least one mixing chamber wall defining a mixing chamber having a flue gas inlet in fluid communication with said flue gas outlet, a dilution air inlet, and a mixing chamber flue gas outlet, and an induced draft blower removably secured to said at least one mixing chamber wall having a blower flue gas inlet in communication with said mixing chamber flue gas outlet and a vent gas outlet, a method for converting said apparatus between a high temperature vent mode and a low temperature vent mode comprising the steps of:

inserting an orifice plate having an orifice having an area smaller than said mixing chamber flue gas outlet area between said at least one mixing chamber wall and said induced draft blower, whereby said orifice is disposed between said mixing chamber flue gas outlet and said blower flue gas inlet and a portion of said orifice plate seals off said dilution air inlet.

* * * * *